US006389760B1

(12) United States Patent
McDonnell

(10) Patent No.: US 6,389,760 B1
(45) Date of Patent: May 21, 2002

(54) WOOD POST PROTECTIVE SLEEVE

(76) Inventor: Ken McDonnell, 66 Red Horse Rd., Pottsville, PA (US) 17901

( * ) Notice: Subject to any disclaimer, the term of this patent is extended or adjusted under 35 U.S.C. 154(b) by 0 days.

(21) Appl. No.: 09/566,174

(22) Filed: May 4, 2000

(51) Int. Cl.[7] ..... E02D 5/80; A63B 63/08

(52) U.S. Cl. ..... 52/165; 52/169.13; 52/170; 248/156; 248/530

(58) Field of Search ..... 52/40, 165, 169.13, 52/170, 726.3, 726.4, 741.11, 745.17; 248/523, 524, 530, 156; 405/255

(56) References Cited

U.S. PATENT DOCUMENTS

| | | | | |
|---|---|---|---|---|
| 646,970 | A | | 4/1900 | Francis |
| 725,820 | A | | 4/1903 | Beazley |
| 1,611,935 | A | * | 12/1926 | Mitchell |
| 2,724,156 | A | | 11/1955 | Shaw |
| 2,955,331 | A | | 10/1960 | Nelson |
| 3,417,525 | A | * | 12/1968 | Dashio ..... 52/298 |
| 3,467,490 | A | | 9/1969 | Sommer |
| 3,611,736 | A | | 10/1971 | Goodman |
| 4,244,156 | A | | 1/1981 | Watts, Jr. |
| 4,779,735 | A | | 10/1988 | Kelso, Jr. |
| 4,799,340 | A | | 1/1989 | Lichau et al. |
| 4,908,085 | A | | 3/1990 | Makus et al. |
| 5,090,165 | A | | 2/1992 | Kenny |
| 5,138,806 | A | | 8/1992 | Marx et al. |
| 5,315,796 | A | | 5/1994 | Gruhlke |
| 5,492,429 | A | * | 2/1996 | Hodges ..... 52/165 X |
| 5,516,236 | A | | 5/1996 | Williams et al. |
| 5,571,229 | A | * | 11/1996 | Fitzsimmons et al. ..... 52/40 |
| 5,625,988 | A | * | 5/1997 | Killick ..... 52/298 |
| 5,733,613 | A | | 3/1998 | Baecker |
| 5,752,349 | A | * | 5/1998 | Fitzsimmons et al. ..... 52/165 |
| 5,891,583 | A | | 4/1999 | George |
| 6,041,559 | A | * | 3/2000 | Schickert et al. ..... 52/165 |
| 6,098,353 | A | * | 3/2000 | Stanfield ..... 52/170 |
| 6,095,480 | A | * | 8/2000 | Mutschler ..... 248/524 |

FOREIGN PATENT DOCUMENTS

| | | |
|---|---|---|
| GB | 2123872 A | 2/1984 |

* cited by examiner

*Primary Examiner*—Robert Canfield
(74) *Attorney, Agent, or Firm*—Mitchell A. Smolow; Carmen Santa Maria; McNees Wallace & Nurick LLC

(57) ABSTRACT

The present invention is directed to an improved wood post protective sleeve that provides protection against conditions that promote post deterioration, allows for rapid dissipation of trapped exhaust air within the sleeve upon insertion of the post into the sleeve, and provides increased resistance to uplifting or downpressing displacing forces placed upon the post. In one form, the improved post protective sleeve comprises a body and at least one extending displacement resistant projection. The body comprises an internal surface and an external surface with an open end opposed to a bottom wall. The open end slidably receives a ground insert portion of a post. The bottom wall retains the ground insert portion of the post. At least one displacement resistant projection extends from the external surface, and a retainer secures the ground insert portion of the post to the body, preventing the ground insert portion of the post from uplifting out of and separating from the body. The internal surface has at least one venting channel to provide a rapid escape path for exhaust air trapped within the protective sleeve as the ground insert portion of the post is travels downward within the body. In a different form, the venting channel is omitted. In still another form of the present invention, there is at least one bottom channel within the bottom wall. This bottom channel communicates with at least one venting channel so as to further assist in allowing trapped air to rapidly escape as the ground insert portion of a post travel downward within the body.

20 Claims, 3 Drawing Sheets

WOOD POST PROTECTIVE SLEEVE

FIELD OF THE INVENTION

The present invention relates generally to wood posts, and specifically, to a protective sleeve for wood posts used in the construction industry that both increases the life of the post and prevents uplift of the post after it is back-filled.

BACKGROUND OF THE INVENTION

Post frame construction has become increasingly popular. Unlike conventional framing, in which the frame is supported by a sole plate resting on for example, a concrete or block foundation, in post frame construction the framing is supported by vertical posts imbedded within the ground.

The flexibility of post frame construction makes it particularly attractive for construction projects requiring, for example, big door openings for combines, airplanes, hay trucks, indoor horse complexes, or sports facilities. Often utilized in horse barns, retail, and commercial/industrial facilities, post frame construction is increasingly being used in, for example, country club, church, and residential construction.

Because these wooden posts are embedded into the earth, they are prone to decay at or below the ground line during the life of the post. The rapidity of the decay is generally dependent upon many factors, among them climate and soil conditions. The major cause of deterioration of the post at or below the ground line is attack by fungi, insects or both. Fungi, which are microscopic plants, must have organic material in which to live, and the post offers a food supply. The growth of the fungi is dependent upon the surrounding conditions; growth includes such requirements as air, mild temperatures, and moisture. All of these conditions are generally present in the soil at or just below the ground line of the post.

Numerous methods have been described to provide protection against conditions that promote post deterioration. One such attempt has been to place the embedded post end within a sleeve of high-density polyethylene manufactured from a molding process. The sleeve contains v-shaped in cross section, vertical projecting vents to provide for the escape of exhaust air which may become trapped between the bottom of the post and the bottom of the sleeve.

Another method of attempting to protect wooden posts includes excavating a substantial amount of dirt around the embedded post end to effectuate treating the wood with a preservative, then placing a protective bandage, usually tar paper, around the post, and finally, back-filling the excavated portion around the post.

Still another method of attempting to protect wooden posts is directed to excavating around a post to expose a portion of the post from 1–3 feet, cleaning the post, and then filling the excavation with a foamable resin which 1) foams to completely seal the exposed pole portion from the excavation, 2) fills the excavation, and 3) when the resin hardens, resets the pole in the ground.

Still other attempts to protect wooden posts include a synthetic plastic sleeve formed of synthetic plastic sheeting comprising a liquid impervious, non-biodegradable flexible synthetic plastic film. The film contains a dry film biocide for inhibiting the growth of micro organisms. The sleeve is dimensioned to fit slidably over a timber pole and by heating, to shrink tightly onto the pole.

The prior art attempts to protect wooden posts have all failed to deal with the problem of the wooden post dislodging from the sleeve, or the dislodgment of the post and sleeve as a unit when the structure has been submitted to uplifting or downpressing displacing forces such as that imposed by for example, high winds. During high winds, the design of the structure, particularly if the structure contains overhangs, or if the building is an open-sided pavilion, can act as an airfoil, thereby transmitting substantial uplifting forces to the posts. When these uplifting forces become great enough, the posts can be uplifted completely out of the ground, thereby causing a loss of structural integrity.

To combat these uplifting or downpressing displacing forces, design specifications often call for a hole to be drilled through a portion of the ground insert portion of a post and placement of a twelve inch section of reinforcement bar through the drilled hole prior to cement fill or back-fill. Although the reinforcement bar helps to resist displacing forces, the hole drilled both weakens the post and acts as an entry point for moisture and pests along the reinforcement bar, thus facilitating deterioration of the post.

What is needed is an improved wooden post protector that allows for easy post insertion, protects wooden posts against conditions that promote post deterioration, and at the same time provides increased resistance to post uplifting or downpressing displacing forces.

SUMMARY OF THE INVENTION

The present invention is directed to an improved wood post protective sleeve that provides protection against conditions that promote post deterioration, allows for rapid dissipation of trapped exhaust air within the sleeve upon insertion of the post into the sleeve, and provides increased resistance to uplifting or downpressing displacing forces placed upon the post.

In one form, the improved post protective sleeve comprises a body and a plurality of extending displacement resistant projections. The body comprises an internal surface and an external surface with an open end opposite to a bottom wall. The open end slidably receives a ground insert portion of a post.

The bottom wall supports the ground insert portion of the post. At least one displacement resistant projection extends from the external surface, and at least one retainer retains the ground insert portion of the post to the body, preventing the ground insert portion of the post from uplifting out of and separating from the body.

The internal surface has at least one rounded venting channel to provide a rapid escape path for exhaust air trapped within the protective sleeve as the ground insert portion of the post travels downward within the body.

In a different form, the venting channel is omitted.

In still another form of the present invention, there is at least one bottom channel within the bottom wall. This bottom channel communicates with at least one venting channel so as to further assist in allowing trapped air to rapidly escape as the ground insert portion of a post travels downward within the body.

An advantage of the present invention is that the addition of displacement resistant projections, heretofore unknown in the art, helps to resist displacing forces brought on for example, by wind blowing through overhanging architectural designs of buildings being supported by the posts. Unlike reinforcement bar passed through a hole drilled through a ground insert portion of a post, the present invention neither weakens the post, nor allows moisture or pests to enter into the post.

Another advantage of the present invention is that the retainer secures the sleeve to help tie the post into the protective sleeve body and thereby give additional resistance to displacing forces.

Still another advantage of the present invention is that the grooves in the bottom wall communicating with the grooves on the internal surface aid in rapidly directing trapped exhaust air from within the sleeve. As the ground insert portion of the post is inserted into the sleeve, a piston effect is created. Without a means to dissipate trapped exhaust air, the back pressure created by the trapped exhaust air would make insertion of the ground insert portion of the post laborious.

While the prior art has disclosed v-shaped grooves running the length of the sleeve the v-shape has a propensity for debris to become wedged in the "v" easily clogging the groove, limiting the rapid escape of trapped exhaust air. An advantage of rounded escape vents is their decreased likelihood to become blocked and clogged.

Still another advantage of the present invention is the addition of grooves in the bottom wall communicating with the grooves on the internal surface, producing greater efficiency in dissipating the trapped escape air.

Other features and advantages of the present invention will become apparent from the following more detailed description of the preferred embodiment, taken in conjunction with the accompanying figures which illustrate, by way of example, the principles of the invention.

DETAILED DESCRIPTION OF THE INVENTION

Figure 1:
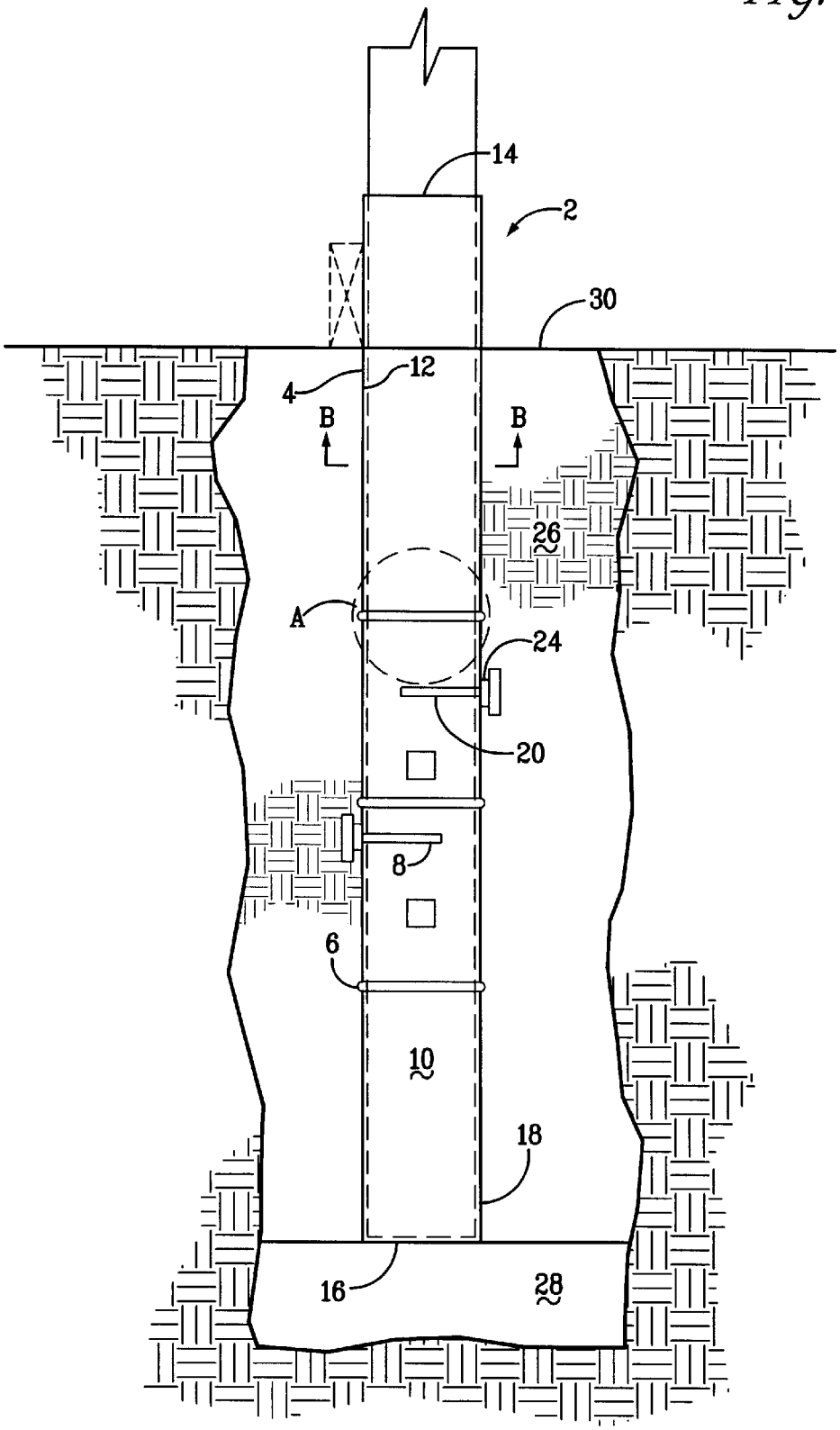
FIG. 1 is a frontal view of the improved wood post protective sleeve.

Referring now to the Figures, where like parts are numbered the same, in accordance with a preferred embodiment of the invention, an improved wood post protective sleeve 2 is provided. The sleeve 2 comprises a body 4, at least one displacement resistant projection 6, and at least one retainer 8 to retain the body 4 to a ground insert portion of a post 10.

The present invention is manufactured from material impervious to moisture such as for example, polyethylene, preferably high density polyethylene, preferably manufactured through a molding process for example, injection molding. The body 4 is in a form to closely resemble the cross-section of a ground insert portion of a post 10 to be received within the body 4. For example, in wood post construction, the wooden posts typically are 6×6 wooden posts which have a final dimension, after milling or planing, of approximately 5½ inches square. Other commonly used sizes are solid sawn pressure treated 4×4 machined to 3½ inches square; 4×6 machined to 3½×5½ inches; 6×6 machined to 5½ inches square; 6×8 machined to 5½×7½ inches and laminated lumber 3 ply 2×6 equivalent to 6×6, finished to 5¼×4 1/16 inches; 4 ply 2×6 equivalent to 6×8, finished to 5¼×5⅜ inches; 3 ply 2×8 equivalent to 6×8, finished to 7×4 1/16 inches; and 4 ply 2×8 equivalent to 8×8, finished to 7×5⅜ inches.

The body 4 which is in the form of a casing, would have an inside dimension that is slightly oversized by for example, about 1/32 inch to about ¼ inch, preferably about ⅛ inch of the post it encases. While ideally, the space between the wooden post 10 and the interior surface of the body 4 should be kept to a minimum, it should be appreciated that even though the body is resilient and has some flexibility, there needs to be some clearance between the post and the internal surface 12 of the body 4 to accommodate imperfections in the wood post 10 such as for example, warping, bowing, twisting, or an oversized machined wood post.

The wall thickness is at least about 1/16 inch, preferably about 1/16 inch to about ¼ inch, most preferably about ⅛ inch to allow the interior surface to compress against the ground insert portion of the post 10 after back-filling, thus insuring intimate contact of the interior surface 12 against the post, and thereby eliminating post wiggle within the sleeve 2. The sleeve 2 is about 54 inches to about 66 inches, preferably about 60 inches in length. In all cases, the length of the sleeve 2 should exceed the length of the ground insert portion of the post embedded within the ground, so that a portion of the body 4 extends above grade 30. The extension above grade 30 may be about six to about 15 inches, preferably about 12 inches. By extending about 12 inches above grade 30, the body 4 terminates within the protective covering of the structure so as to aid in preventing rain, snow, sleet, and the like from entering the body 4. Alternatively, this open end 14 of the body 4 may be sealed with sealing material such as for example, tape, caulk, silicone, expanding foam and the like, regardless of whether the body 4 is covered by the building structure or exposed.

Opposite to the open end 14 of the body 4 is a bottom wall 16, which after insertion of the ground insert portion of the post 10 within the body 4, rests against the end of the post, thereby creating a positive stop, protecting the end of the post 10, and helping to support the post within the body 4.

At least one displacement resistant projection 6 extends from the external surface 18 of the body 4. These projections are integral with the body 4 as part of the manufacturing process. These projections are at least ¼ inch, preferably about ¼ inch to about 1 inch, most preferably about ⅜ inch in thickness, and extend at least ¼ inch, preferably about ¼ inch to about 1 inch, most preferably about ⅜ inch outward from the external surface 18 of the body 4. Engineering studies have determined that extensions of about ⅜ inch provide resistance to displacement forces about equal to that provided by prior art reinforcement bar methods. It should be appreciated that increasing the dimensions, particularly the outward extending dimension, will create increasing resistance to these displacement forces. Although not required, the displacement resistant projections 6 completely encircle the body 4. While only one displacement resistant projection 6 is sufficient to provide a predetermined resistance to displacement forces, in the preferred embodiment three displacement resistant projections 6 are evenly spaced sub-grade 30 for example, at one-foot intervals along the length of the body 4.

These displacement resistant projections 6 act in effect as ribbing, providing increased resistance to compression of the sleeve 2. Therefore, the displacement resistant projections 6 must be spaced sufficiently far apart to allow the interior surface 12 located between displacement resistant projections 6 to compress against the post 10 after back filling.

Figure 2:
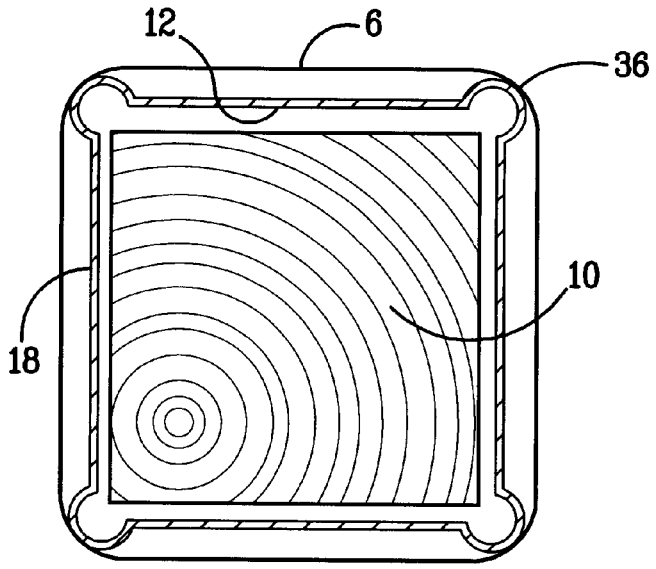
FIG. 2 is a cross-section of the improved wood post protective sleeve at level B—B in FIG. 1.

As shown in FIG. 2, contained within the body 4, preferably molded within the internal surface 12 of the body 4, is at least one venting channel 36, which allows trapped exhaust air to escape as the ground insert portion of the post 10 is inserted into the body 4. If the contractor elects not to seal the open end 14 of a body 4 which is within the confines of the erected structure, the venting channel 36 would allow any trapped moisture to evaporate. It is envisioned that some contractors would elect to not seal the open end 14 immediately, but rather allow some time for example, about six weeks, to pass after the structure has been erected to allow any trapped moisture to evaporate through the venting channels 36 prior to sealing the open end 14 as described above.

The venting channels 36 travel the length of the body 4 from the open end 14 to the bottom wall 16. In the preferred embodiment, in cross-section, the venting channel 36 is a rounded out-puffing of at least one corner of the body 4, preferably all four corners. It should be appreciated that the corners are not merely rounded, but rather, the corners are extended or "out-puffed" utilizing about at least a ¼ inch, preferably about a ¼ inch to about 1 inch, most preferably about a ⅜ inch radius. An advantage of this "out-puffing" is that after back-filling, when the interior surface 12 compresses against the post 10, the venting channels 36 remain unblocked.

Figure 3:
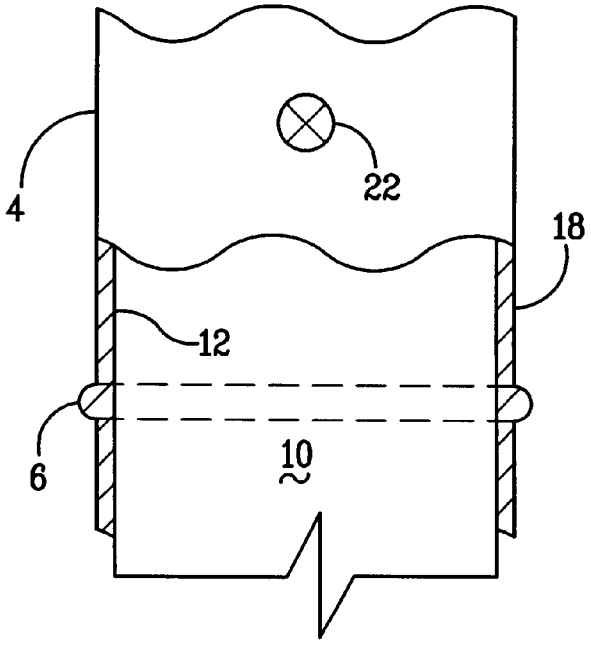
FIG. 3. is a detailed view at level A in FIG. 1.

Returning to FIG. 1, at least one retainer 8 is provided to retain the ground insert portion of a post 10 to the body 4, preventing removal of the ground insert portion of a post 10 from the body 4. This may take the form of for example, one or more lag screws 20 passing through the external surface 18 of the body 4 into the ground insert portion of the post 10. Preferably, the lag screws 20 are about ½ inch lag screws 20 placed one on each face of the body 4. The lag screws 20 should be staggered so as not to have any two at the same level, to prevent structural weakening of the ground insert portion of the post 10. As part of the manufacturing process, indicator locations 22 for placement of the lag screws 20 may be molded into the external surface 18 of the body 4, as shown in FIG. 3. Placement of lag screws 20 should be avoided above grade 30 because sheering forces are greatest in the area immediately above grade 30 and structural weakening of the post 10 such as for example, by drilling and placement of a lag screw 20 should be avoided in this area.

Prior to placement of the lag screw 20, a water impervious washer 24 for example, a neoprene or polyethylene washer 24 is placed on the lag screw 20 so as to prevent moisture from entering the post 10 through the hole by deforming and sealing the hole in the external surface 18 of the body 4 created by the lag screw 20. Alternatively, a water resistant sealant material such as silicone may be placed into or around the hole created for the lag screw 20 prior to placement of the lag screw 20. The head of the lag screw 20 will provide additional resistance to uplifting forces. Another alternative is a lag screw 20 with a washer face. As the screw is screwed into the wood, the washer compresses against the body 4, forcing it against the body 4 and post 10 to form a seal.

Figure 4:
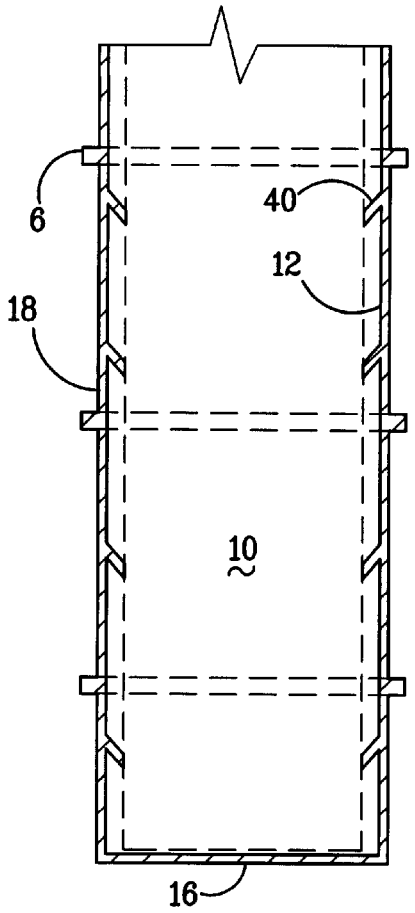
FIG. 4 is a profile of a different embodiment showing the downwardly angled projections.

As an alternative to lag screws 20 and water resistant washers 24 or sealing material, the internal surface 12 of the body 4 may be molded such that there are a plurality of downwardly angled projections 40 for example, in the form of barbs, extending from the internal surface 12 of the body 4, as shown in FIG. 4. The downwardly angled projections 40 should be able to be displaced without cracking, yet spring back against the post. These downwardly angled projections 40 allow the ground insert portion of a post 10 to pass freely upon insertion, yet offer resistance to the removal of the post 10 once the ground insert portion of the post 10 has been inserted within the body 4. An advantage of these downwardly positioned projections over lag screws 20 is that the body 4 would not require holes to accept the lag screw 20, thus eliminating one potential source of moisture or pest contamination. However, lag screws 20 allow for easier movement of the body 4 around imperfections in the post 10 during post insertion.

In one embodiment, the present invention would operate as follows:

After a location for placement of the post 10 has been selected, a hole is excavated to a depth of about 54 inches and a concrete footer 28 of about 6 inches in thickness is poured and allowed to set. The ground insert portion of a post 10 is then slidably inserted into the open end 14 of the body 4 until the bottom of the post 10 contacts the bottom wall 16. The location for placement of the lag screws 20 are determined, or alternatively this location has been predetermined and appropriate markings are located on the external surface 18 of the body 4. A neoprene washer 24 is then slid over the lag screw 20 and a self-tapping lag screw 20 (which, alternatively, may be pre-assembled to the body 4 with a washer 24) is screwed through the external surface 18 of the body 4 into the ground insert portion of the post and tightened to compress and/or deform the neoprene washer 24 sufficient to create a moisture resistant seal. The ground insert portion of the post 10, now secured to the body 4 of the present invention, is then placed within the excavated hole until the bottom wall 16 rests upon the hardened concrete footer 28. The post 10 is leveled and held in place using known techniques while material, preferably concrete, is back-filled into the previously excavated hole. The concrete or other back-fill 16 is in intimate contact with the external surface 18 of the body 4 as well as with the displacement resistant projections 6. Once back-filled, the extending displacement resistant projections 6, along with the head of the lag screw, now embedded within the back-fill 26, serve to resist displacement forces.

As mentioned previously, the contractor may elect to seal the body 4 open end 14 at the time of back-fill, or the contractor may elect to delay a predetermined amount of time to effectuate evaporation of any moisture trapped within the body 4 and subsequently seal the open end 14 after evaporation of this trapped moisture. If the open end 14 remains within protected space, the contractor may elect to leave the open end 14 unsealed.

The venting channel 36 allows trapped air to escape during the piston-like effect created as the ground insert portion of the post 10 is inserted and slid within the body 4. Optionally, a lubricant and/or a protective coating may be applied to the post 10 prior to placement within the body 4 to effectuate easier placement. Furthermore, an adhesive may be applied to the post 10 prior to placement that would before setting act as a lubricant to allow easier placement of the ground insert portion of the post 10 within the body 4 and after setting allow for even greater increased resistance to post removal.

Figure 5:
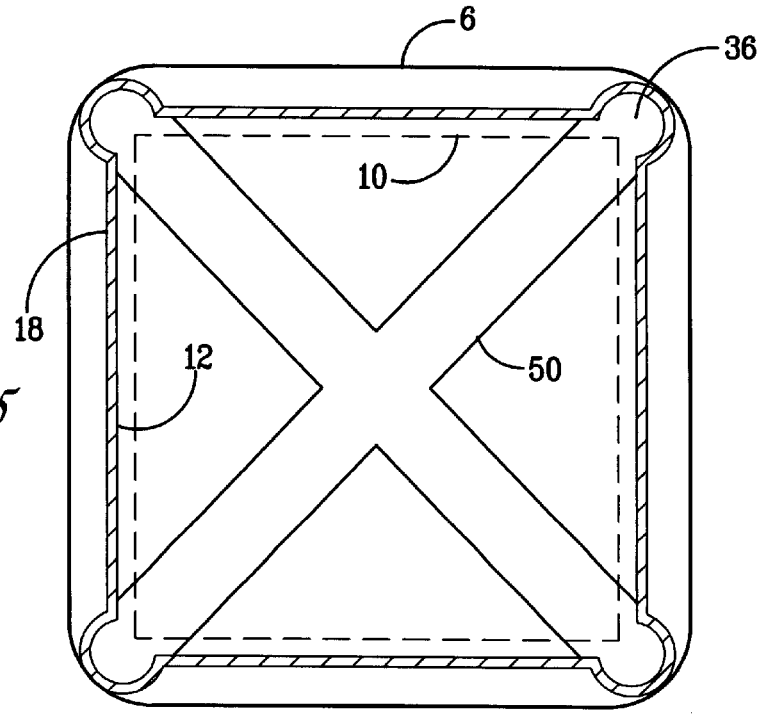
FIG. 5 is a cross-section of a different embodiment of the improved wood post protective sleeve with the bottom channel.

As shown in FIG. 5, in another form of the present invention, at least one bottom channel 50 is molded into the bottom wall 16 of the invention. At least one end of any bottom channel 50 communicates directly with the venting channel 36 contained within the internal surface 12 of the body 4. This bottom channel 50 further facilitates escape of any trapped exhaust air during insertion of the ground insert portion of the post 10 and allows for better evaporation of retained moisture through the bottom end of the post 10.

It should be appreciated that both the venting channels 36 and the bottom channel 50 merely provide avenues of escape for trapped exhaust air and retained moisture. They provide no resistance to displacement forces. As utilized in the preferred embodiment, it would be difficult to insert the ground insert portion of the post 10 within the body 4 without a venting channel 36. However, once inserted, the post would receive the same protection against environmental deterioration and provide the same resistance to displacement forces regardless of whether or not a venting channel 36 is present.

Therefore, in yet another embodiment, the venting channel 36 and/or the bottom channel 50 are omitted.

The improved wood post protective sleeve 2 of the present invention not only resists uplifting displacement forces, it also resists downward displacement forces as would occur for example, when a portion of the footer 28 settles, creating a space between the footer 28 and the bottom wall 16. The back-fill mass 26 would continue to be supported by a portion of the footer 28 and the surrounding ground, and therefore, would remain stable. Without the displacement resistant projections 6 in intimate contact with the back-fill 26 mass, the post (with or without a protective barrier) would displace downward to once again rest on the footer 28, creating loss of structural integrity to the building above.

The moisture impervious sleeve 2 of the present invention also assists in protecting the environment by preventing hazardous material from leaching into the surrounding soil. For example, CCA (chromated copper arsenate) pressure treated wood, often used in post-beam construction, contains chromium, arsenic and copper, all hazardous materials.

Although set forth as a post protector for a wooden post, it will be understood that the protector of the present invention can be dimensioned and adapted for use with metal support members such as ferrous support members inserted into the ground and subject to deterioration as a result of exposure to moisture.

Although the present invention has been described in connection with specific examples and embodiments, those skilled in the art will recognize that the present invention is capable of other variations and modifications within its scope. These examples and embodiments are intended as typical of, rather than in any way limiting on, the scope of the present invention as presented in the appended claims.

What is claimed is:

1. A protective sleeve for use with an elongate member, the protective sleeve comprising:

a moisture impervious body in a form having a pre-selected length and pre-selected cross section, the body cross section, adapted to closely conform to the cross section of a ground insert portion of the elongate member, the body having an open end to slidably receive an end of the ground insert portion of the elongate member, a bottom wall opposite the open end for supporting the end of the ground insert portion of the elongate member, an internal surface and an external surface;

at least one displacement resistant projection extending from the external surface, the at least one projection providing increased resistance to displacement forces;

at least one venting channel forming a portion of the internal surface;

the bottom wall for supporting the ground insert portion of the elongate member; and at least one retainer for permanently retaining the ground insert portion of the elongate member to the moisture impervious body, thereby preventing removal of the elongate member from the protective sleeve.

2. The post protective sleeve of claim 1 further comprising at least one bottom channel in the bottom wall, the bottom channel communicating directly with at least one internal surface venting channel.

3. The post protective sleeve of claim 1 wherein the body comprises a light weight, resilient, non-brittle material not subject to degradation by exposure to moisture and soil.

4. The post protective sleeve of claim 3 wherein the material includes plastic.

5. The post protective sleeve of claim 3 wherein the material includes at least one material selected from the group consisting of polyethylene, silicone, polyurethane and polytetrafluoroethylene.

6. The post protective sleeve of claim 1 wherein the at least one displacement resistant projection is at least about ¼ inch in thickness and extends outward at least about ¼ inch from the external surface of the body.

7. The post protective sleeve of claim 1 wherein the body is at least about 1/16 inch in thickness.

8. The post protective sleeve of claim 1 wherein a rounded venting channel is formed along the internal surface of the body and extends along the internal surface from the bottom wall to the open end.

9. The post protective sleeve of claim 1 wherein the venting channel is formed within at least one corner and out-puffs from the at least one corner a radius of at least about ¼ inch.

10. The post protective sleeve of claim 1 wherein after insertion into a grade the body extends above the grade about 6 inches to about 18 inches.

11. The post protective sleeve of claim 1 wherein the at least one retainer for permanently retaining the ground insert portion of the elongate member to the moisture impervious body includes a lag screw and a deformable washer, the lag screw adapted to pass through the external surface of the body into the ground insert portion of the elongate member and tightened such that the washer is compressed an adequate amount to create a water tight seal.

12. The post protective sleeve of claim 1 wherein the at least one retainer for permanently retaining the ground insert portion of the elongate member to the moisture impervious body includes a screw with a washer face that compresses against the body to form a seal.

13. The improved post protective sleeve of claim 1 wherein the at least one retainer for permanently retaining the ground insert portion of the elongate member to the moisture impervious body includes at least one downwardly angled projection extending from the internal surface of the body.

14. A method for protecting a post from deterioration as a result of underground exposure and providing increased resistance to displacement forces comprising the steps of:

a) providing a post of a first pre-selected length;

b) providing a sleeve body to protect the post from deterioration, the sleeve body having a second pre-selected length less than the length of the post and having a pre-selected cross section extending the second pre-selected length, the body having an open end opposite to a bottom wall, an internal surface and an external surface forming an aperture extending along the second pre-selected length;

at least one displacement resistant projection extending outwardly from the external surface of the body;

at least one venting channel formed within the internal surface of the body;

the open end slidably receiving a ground insert portion of the post;

the bottom wall of the body supporting the ground insert portion of the post;

c) permanently and non-removably securing the body to the post with a retaining member; then d) inserting the secured, non-removable ground insert portion of the post and the sleeve body into an excavated hole of predetermined depth; and e) back-filling material against the sleeve body.

15. The method of claim 14 further comprising the step of sealing the open end of the body by inserting a moisture resistant material between the body and the post.

16. The method of claim 14 further comprising the step of applying a lubricant on an interface between the post and the sleeve body to case insertion of the ground insert portion of a post into the sleeve.

17. The method of claim 14 further comprising the step of applying a preservative to the ground insert portion of the post prior to placement of the post into the sleeve.

18. The method of claim 14 further comprising the step of applying an adhesive to the ground insert portion of the post prior to placement of the post into the sleeve.

19. The method of claim 14 further including the step of extending the body above the excavated hole about 6 inches to about 18 inches.

20. A protective system for an elongate member subject to degradation by exposure to moisture comprising:

a post having a ground insertion portion and an end opposite the ground insertion portion;

a moisture impervious body having a pre-selected length and a pre-selected cross section, wherein the cross section closely resembles the cross section of the ground insert portion of the post received by the body, the body including an open end opposed to a bottom wall, an internal surface and an external surface;

at least one displacement resistant projection extending from the external surface;

the open end slidably receiving the ground insert portion of the post;

the bottom wall supporting the ground insert portion of the post; and a permanent retainer non-removably affixing the body to the ground insert portion of the post while preventing moisture from passing from the external surface to the internal surface.

* * * * *